US006061875A

United States Patent [19]

Laird

[11] Patent Number: 6,061,875

[45] Date of Patent: May 16, 2000

[54] POWERED ROLL GIN STAND

[75] Inventor: Joseph Weldon Laird, Lubbock, Tex.

[73] Assignee: The United States of America, as represented by the Secretary of Agriculture, Washington, D.C.

[21] Appl. No.: 09/326,955

[22] Filed: Jun. 7, 1999

[51] Int. Cl.[7] ..... D01B 1/04

[52] U.S. Cl. ..... 19/48 R; 19/55 R; 19/62 R

[58] Field of Search ..... 19/39, 48 R, 54, 19/55 R, 56, 57, 62 R, 63, 64.5

[56] References Cited

U.S. PATENT DOCUMENTS

| | | | |
|---|---|---|---|
| 1,485,833 | 3/1924 | Cumpston | 19/55 R |
| 1,986,901 | 1/1935 | Starke et al. | 19/55 R |
| 1,988,850 | 1/1935 | McLean | 19/55 R |
| 1,999,845 | 4/1935 | McLean | 19/55 R |
| 2,100,786 | 11/1937 | McLean | 19/55 R |
| 2,149,146 | 2/1939 | Morgan | 19/62 R |
| 4,967,448 | 11/1990 | Mizer | 19/48 R |
| 4,974,294 | 12/1990 | Vandergriff | 19/48 R |

OTHER PUBLICATIONS

Cotton Ginners Handbook, Agricultural Handbook No. 503, Dec. 1994, W. S. Anthony and William D. Mayfield, Managing Editors, pp. 42–46, pp. 90–102, pp. 323–330.

*Primary Examiner*—John J. Calvert
*Assistant Examiner*—Gary L. Welch
*Attorney, Agent, or Firm*—M. Howard Silverstein; Randall E. Deck; John D. Fado

[57] ABSTRACT

An improved gin saw stand for ginning seed cotton or reginning cotton seed is disclosed. The gin stand of this invention includes an inlet in the roll box allowing seed cotton or seed to be fed directly therein without the need for a huller front or its associated picker roller and huller ribs. A power driven paddle roller having a plurality of outwardly extending elongated paddles rotating in the opposite direction from the first gin saw cylinder is also placed within this roll box. The elongated paddles of this paddle roller are effective for independently turning the seed cotton and/or seeds accumulated in the roll box, consequently bringing them into contact with the gin saw cylinder where the lint may be gripped by the teeth of the saw. To control the rate of seed passage between the blades of the gin saw cylinder and their subsequent discharge from the gin stand, a power driven, seed metering roller is positioned adjacent to the saw cylinder and on the same side thereof as the ginning ribs. This seed metering roller includes a plurality of outwardly extending projections or fingers extending between the spaced apart blades of the gin saw cylinder rotating in the same direction as the saw.

9 Claims, 4 Drawing Sheets

- Prior Art -

POWERED ROLL GIN STAND

BACKGROUND OF THE INVENTION

1. Field of the Invention

The invention relates to a novel gin stand for ginning seed cotton or reginning cotton seed.

2. Description of the Prior Art

The removal of seeds, trash or foreign matter from cotton lint presents significant problems to cotton producers and textile mills. High levels of such impurities reduce the price the producer receives for the product. However, efforts to remove seeds and reduce trash levels often cause fiber damage, decreasing the quality of the resulting yarn and cloth.

In harvesting, seed cotton is stripped or picked from the plant, deposited in a trailer or other vehicle, and transported to a cotton gin. The cotton gin has apparatus for receiving the seed cotton, removing the seeds from the long cotton fiber or lint, cleaning the lint, and pressing the lint into bales for transport to textile mills or compresses for further operation. Lint-free seed recovered from the ginning operation may also be retained for the production of oil, as a protein supplement in animal feed, and for planting.

In a typical ginning process, seed cotton is transported from a trailer or module into a green-boll trap in the gin where green-bolls, rocks and other heavy foreign matter are removed to prevent damage to the machinery. The cotton is then automatically transported into a series of dryers followed by a stick machine where the cotton is dried to desired moisture levels and large pieces of trash are removed. After drying and cleaning, the cotton is distributed to each saw type gin stand (referred to herein as a gin saw stand) by a conveyer whereupon it is metered into the gin saw stands with an extractor-feeder. From the gin stand, the cotton fiber is next formed into a batt and transported to lint cleaners for further cleaning before baling.

A commercial saw type gin stand which is currently in use is shown in FIG. 1. Referring to the figure, conventional gin saw stands 10 typically contain a large chamber referred to as a huller front 11 wherein the seed cotton is deposited. A gin saw cylinder 12, composed of a large number of spaced apart circular blades 13 rotating about a common axis 14, is combined with operably associated ribs positioned between the blades of the saws in order to strip the lint from the seed. Briefly, cotton in the huller front 11 is grasped by the teeth on the outer periphery of a first gin saw cylinder 12 and drawn through a first set of widely spaced ribs known as huller ribs 20 positioned between the saw blades. Delivery of the cotton into contact with the teeth of the first saw is assisted by a rotating toothed cylinder, referred to as the picker roller 21, which pushes the cotton in the huller front against the saw. This picker roller is generally positioned with its axis 22 approximately lateral to the axis 14 of the first saw 12, with its outer periphery spaced apart from the outer periphery or teeth of the saw. The locks of cotton are drawn upwardly through the huller ribs and into the lower portion of a roll or seed-roll box 25 positioned above the axis of the saw where the seeds with attached cotton accumulate in a large mass. This mass of seeds and/or seed cotton is commonly referred to as the roll.

The actual separation of the seed from lint takes place in the roll box 25 of the gin stand. A second set of ribs, referred to as the ginning ribs 26, are located in the spaces between the blades of the saw at the downstream end of the roll box, and extend from a position above the periphery of the saw downward through the spaces to near or below the bottom of the saw. Cotton fibers in the roll box are again caught by the teeth of the first saw and passed toward the ginning ribs 26. As the teeth of the saw pass between the ginning ribs, they pull the lint from the seeds, which are too large to pass between adjacent ribs. The seed-free lint proceeds past the ginning ribs 26 where it is removed by a doffing brush 27 and passed out of the gin stand. Meanwhile, seeds which have all or a portion of their lint or long fibers removed therefrom pass downward along the ginning ribs between the saw blades where they eventually fall onto a conveyor 28 positioned below the first saw. In contrast to the lint-free seeds, seeds which retain long fibers thereon are generally pushed back into the mass of seed/cotton in the roll box 25, awaiting to be caught by the saw and repeat the ginning operation. In some models of gin saws, agitators having a serrated outer edge have been placed in the roll box (on an angle relative to the first saw) to assist the first saw in turning the roll of material within the roll box.

A thorough description of a variety commercially available gin saw stands and their operation is provided by Anthony and Mayfield (ed.), Cotton Ginner's Handbook, Agricultural Handbook No. 503, United States Department of Agriculture, Agricultural Research Service, Washington, D.C., 1994, the contents of which are is incorporated in their entirety by reference herein.

Throughput through these existing gin saw stands is reduced, primarily because the removal of the cleaned seeds is impaired by the upward passage of new seed cotton being fed in through the huller front, and because the pickup of lint from the mass in the roll box is slowed by the inability of the saws to pick up seeds having relatively few attached fibers and thereby turn the mass to expose fresh seed cotton. Furthermore, the level of lint removal from the seeds cannot be readily controlled, and seeds discarded from conventional gin stands may contain relatively high levels of lint remaining thereon.

Gin stand performance is also related to the seed roll density. A loose roll assures minimum fiber damage, while a roll that is too tight may result in fiber and seed damage. The gin stand needs to be operated at the highest roll density compatible with low fiber damage to achieve maximum processing capacity. Conventional gin stand feeder controls usually sense the load on the gin saw motor for the control criterion. Adjustment of the position of the seed fingers extending into the roll box may also provide a small variation in the cleaning level for a given motor load. Other gin stand controls sense the pressure within the roll box as the control criterion. These systems prevent the operator from maintaining the cleaning at a fixed level independent of processing rate, and cleaning suffers as processing rate increases. This has lead to the development of gin stands having more saws and of increased width in an attempt to increase processing rate. However, with these systems processing at the levels required in modern cotton gins, about 3–5% of the lint may be left unginned on the seeds.

SUMMARY OF THE INVENTION

We have now discovered an improved gin saw stand for ginning seed cotton or reginning cotton seed. The gin stand of this invention includes an inlet in the roll box allowing seed cotton or seed to be fed directly therein without the need for a huller front or its associated picker roller and huller ribs. A power driven, paddle roller having a plurality of outwardly extending elongated paddles rotating in the opposite direction from the gin saw cylinder is also placed within this roll box. The elongated paddles of this paddle roller are effective for independently turning the seed cotton and/or seeds accumulated in the roll box, consequently bringing them into contact with the gin saw cylinder where the lint may be gripped by the teeth of the saw. To control the rate of seed passage between the blades of the gin saw cylinder and their subsequent discharge from the gin stand, a power driven, seed metering roller is positioned adjacent to the saw cylinder and on the same (upstream) side thereof as the ginning ribs. This seed metering roller includes a plurality of outwardly extending projections or fingers extending between the spaced apart blades of the gin saw cylinder rotating in the same direction as the saw. The speed of rotation is variable, with lower speeds increasing the length of time of exposure of seeds with fiber thereon to the saw and increasing lint removal, and higher speeds increasing throughput through the gin stand.

In accordance with this discovery, it is an object of this invention to provide an improved gin saw stand that performs the ginning at high throughputs without causing significant damage to the fiber, while providing lint-free cotton seed suitable for coating and use as feed or oil source, or for planting.

It is also an object of this invention to provide an improved gin saw stand that provides for increased turning of the roll of seed cotton and/or seeds in the roll box, increasing the contact between the lint on seeds within the roll box and the gin saw cylinder.

Another object of the invention is to provide an improved gin saw stand wherein the rate of discharge of ginned seed from the roll box may be controlled, to ensure complete removal of long fibers from the seeds.

Other objects and advantages of the invention will become readily apparent from the ensuing description.

DETAILED DESCRIPTION OF THE INVENTION

This invention provides an improved saw type gin stand (i.e. gin saw stand) which may be used for ginning seed cotton or reginning cotton seed. With relatively few exceptions, most commercially available strains of seed cotton have two types of fibers. The desired fibers or lint, are the long spinnable fibers (usually about 1 to 1⅛ in. in length) used in textile manufacture, while linters are the short course fibers (usually less than ½ in. long) closely associated with the seed that are not suitable for spinning. The gin stand of this invention is suitable for use with any variety of seed cotton, providing more complete removal of the lint from the seed than previously attainable, even while minimizing damage to the fibers. Furthermore, in contrast to the seed produced from conventional gin saw stands, the resultant seed, is substantially lint-free and is suitable for coating and use as feed or for planting, or for use as an oil source. The linters on the seed remain substantially undisturbed.

Figure 2:
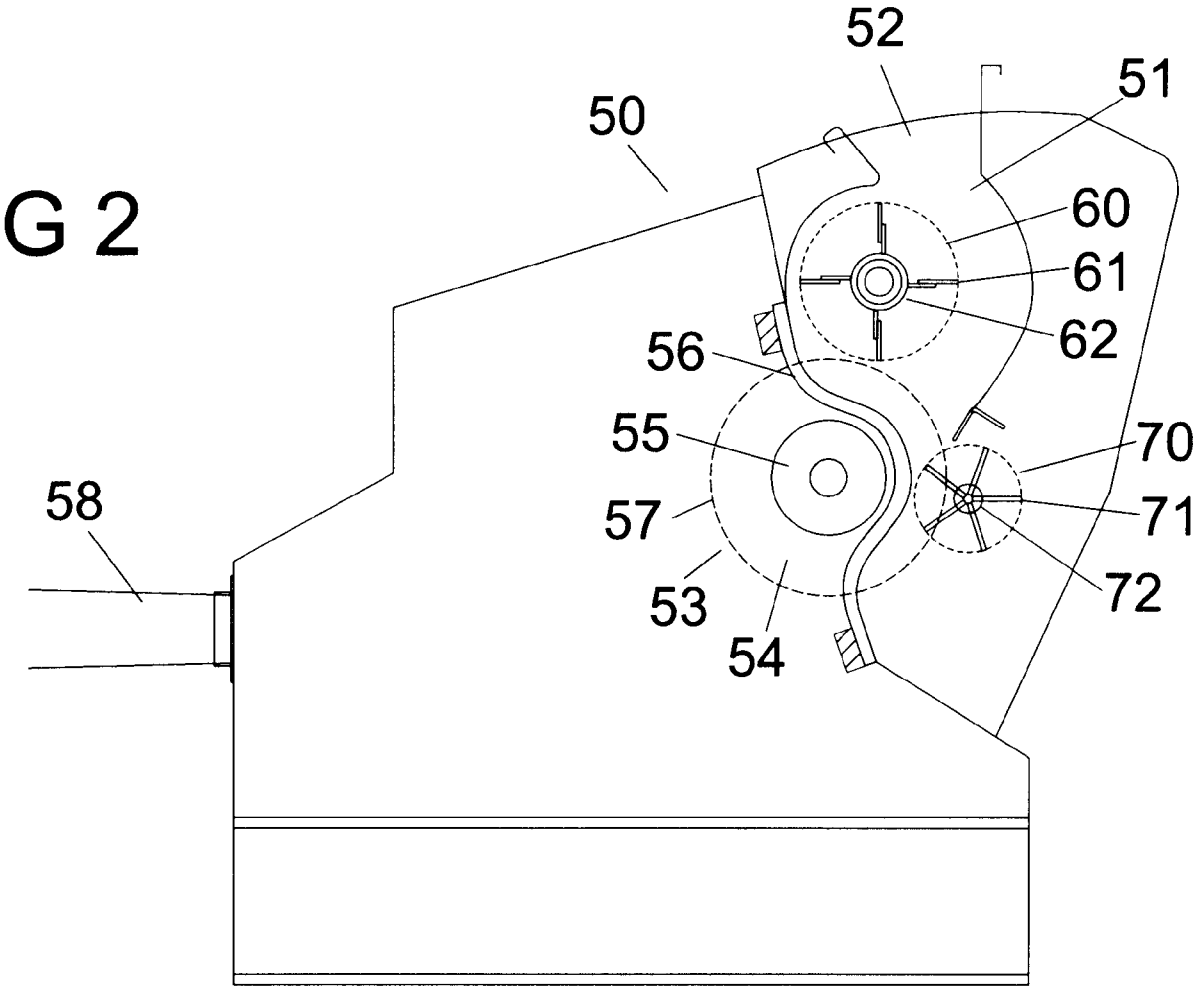
FIG. 2 is a first side view of a gin saw stand of the invention showing the improvements described herein.

Referring now to FIG. 2, the gin saw stand 50 of this invention includes a roll box 51 which has been modified to include an inlet 52 to allow direct addition of seed cotton or seed for reginning therein, such as from a conventional feeder-extractor. The huller front and its associated picker roller and huller ribs common to conventional gin saw stands are no longer necessary and may be omitted. This arrangement allows for the seed to be discharged after its lint has been removed without interference from new seed cotton being fed in through the conventional huller front. A gin saw cylinder 53 having a plurality of spaced apart circular blades 54 rotating about a central axis or shaft 55 is provided adjacent to the roll box. Ginning ribs 56 are positioned in the spaces between these blades extending from above the upper periphery of the blades to below their lower periphery, and are operably associated with the blades to allow lint but not seeds to pass therebetween. The structure and function of the gin saw cylinder and the ginning ribs may be similar to those known in the art. The precise relative position of the roll box and its inlet to the gin saw cylinder is not critical, although it is preferably positioned with its predominant volume above the central axis of the gin saw cylinder and on the upstream side of the ginning ribs, and the inlet is preferably positioned at the upper portion of the roll box.

As the seed cotton or seeds are deposited in the roll box, the long cotton fibers or lint are caught by the teeth 57 (shown as a dashed line) on the outer periphery of the gin saw cylinder 53. The lint is pulled toward the ginning ribs 56, and as the teeth of the saw pass between the ginning ribs, they pull the lint off of the seeds, which are too large to pass between adjacent ribs. The seed-free lint is carried downstream past the ginning ribs 56 where it is removed by a doffing brush and conveyed out of the gin stand through outlet 58.

The separated seeds are caught by the ginning ribs 56 and either pushed back into the roll box or fall between the blades of the saw. Seeds retaining a significant number of long fibers thereon are usually pushed back into the roll box 51 where they combine with seed cotton or other seeds deposited therein. Meanwhile, seeds which have most or all of their lint or long fibers removed therefrom generally pass downward along the ginning ribs between the saw blades.

Figure 4:
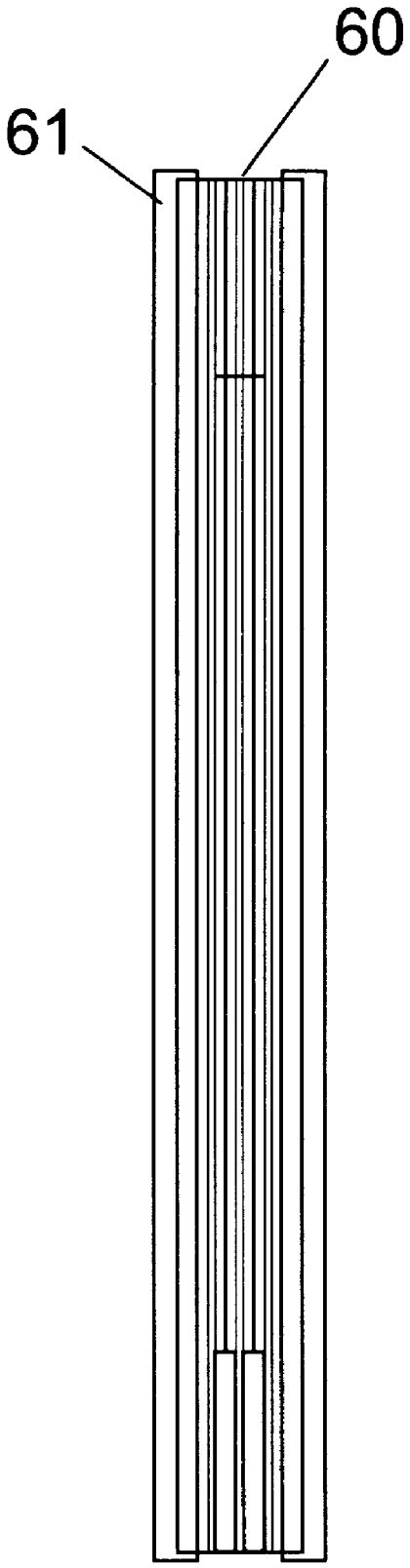
FIG. 4 is a side view of a paddle roller of the invention.

In conventional gin saw stands, as seeds accumulate in the mass of seeds and/or seed cotton (i.e., the roll) in the roll box 51, many seeds do not have enough lint to be efficiently caught by the teeth of the gin saw cylinder, causing the roll to turn or circulate more slowly and reducing ginning throughput. In accordance with this invention, to turn the roll and increase ginning throughput, a paddle roller 60 is placed within the roll box, substantially parallel to and rotating in the opposite direction to the gin saw cylinder but spaced from the periphery of the saw and the downstream wall of the roll box a sufficient distance to allow lint and seed to pass therebetween. Paddle rollers 60 are constructed with a plurality of elongated paddles or fins 61 extending from a rotating shaft 62. The paddles 61 may have a variety of shapes, including but not limited to planar or curved surfaces or angles, and may radiate from the shaft or be positioned at an angle to the radii of the shaft, and they may be constructed from rigid, semi-rigid, or resilient materials. The length of the paddles, their spacing from the gin saw cylinder, and speed of rotation may vary with the type of cotton, desired throughput, the seed load of the material to be ginned, and the size of the gin saw cylinders, and may be determined by the skilled practitioner. However, the paddle size and material of construction should be sufficient to effect turning of the roll in the roll box independently of the gin saw cylinder. By way of example and without being limited thereto, preferred paddle rollers are shown in FIG. 4, and are constructed with rigid strips extending radially outwardly from the shaft with flat resilient strips attached at the outer edge thereof, and the length of the paddles will preferably vary between about 2 to 8 inches (when used with a 12 to 18 inch saw).

Figure 3:
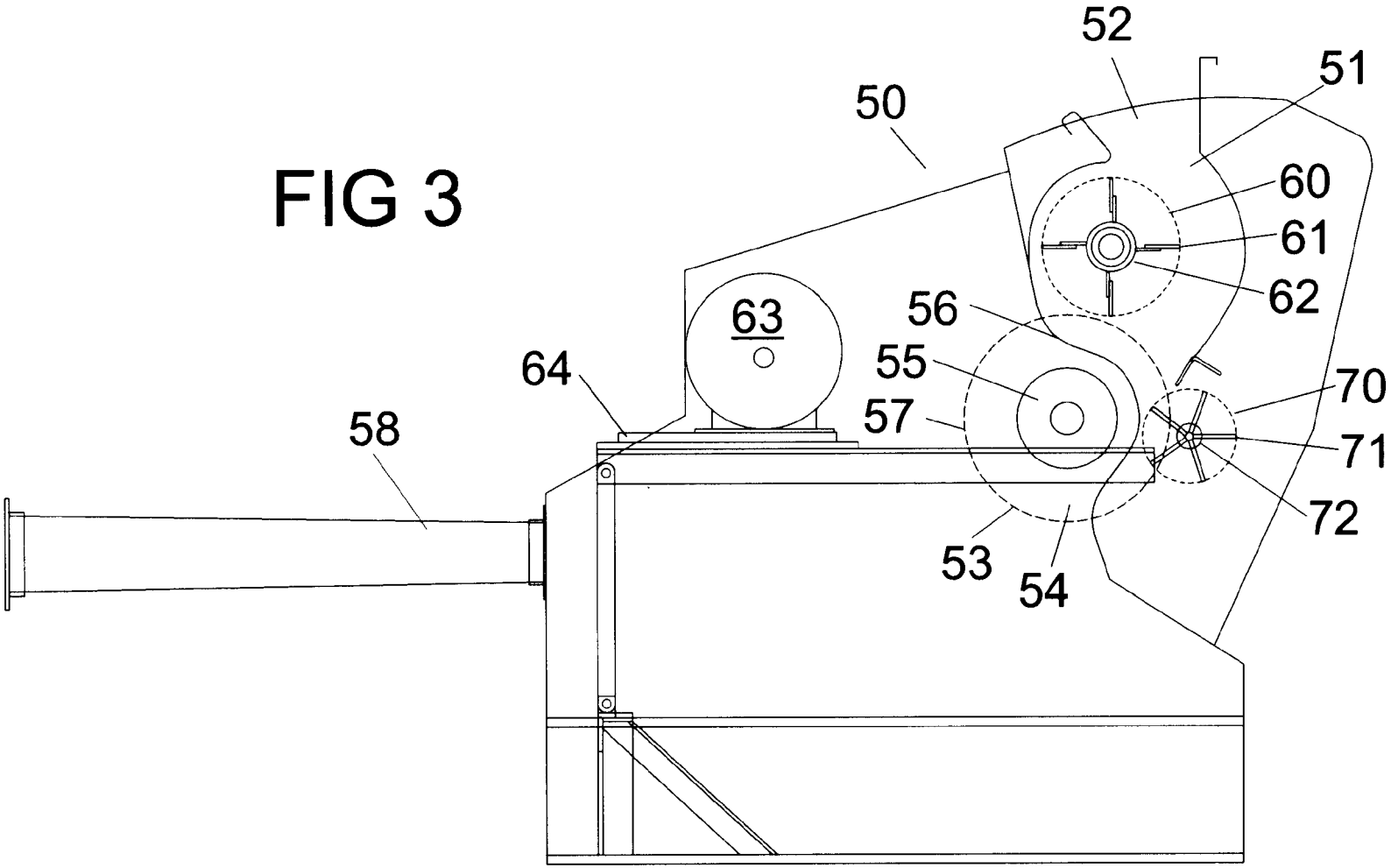
FIG. 3 is a second side view of a gin saw stand of the invention showing the drive mechanism for the paddle roller.

Motor 63 may be provided to drive the paddle roller. As shown in FIG. 3 the motor may be placed on an optional rocking stand 64 to allow the gin front to be moved in and out of ginning position against the gin saw cylinder. In the preferred embodiment, the feed of the seed and/or seed cotton to the gin saw cylinder and thus the rate of ginning may be altered or controlled by using a variable speed motor and altering the speed of the motor and consequently the rate of turning of the roll.

While a portion of the seeds are recycled into the roll, others having relatively fewer lint fibers are not carried into the roll but pass between the blades of the gin saw cylinders. In accordance with this invention, the rate of seed passage between the blades of the gin saw cylinder and thus the level of lint removal from the seeds may be controlled by providing a power driven, seed metering roller 70 adjacent to the saw cylinder and on the same side thereof as the ginning ribs. This seed metering roller 70 rotates in the same direction as the gin saw cylinder and includes a plurality of projections or fingers 71 extending outwardly from a common shaft 72 into the spaces between the blades of the gin saw cylinder. The fingers may have a variety of shapes, including but not limited to angles, teeth, or straight or curved tines, pins or bars, and may radiate from the shaft or be positioned at an angle to the radii of the shaft. The length of the fingers will vary with the size of the gin saw cylinders, and may be determined by the skilled practitioner. However, the number and size of the fingers should be sufficient to extend into the space between the blades and terminate sufficiently near the ginning rib (usually to within about ¼ to 1 inch) to effectively slow or impede the passage of seeds therethrough.

The seed metering roller is preferably provided with a variable speed drive motor, allowing the speed of rotation of the roller to be varied. The level of lint removal from the seeds may be effectively controlled by altering this speed of rotation. Lower speeds will increase the residence time and thus the exposure of the seeds to the saw blades, thereby allowing greater or total lint removal from the seeds before they are discharged from below the gin saw cylinder. Conversely, higher speeds increase discharge of the seeds from the gin saw stand at the expense of decreased seed cleaning. The user may select the appropriate speed in accordance with the desired result.

Figure 1:
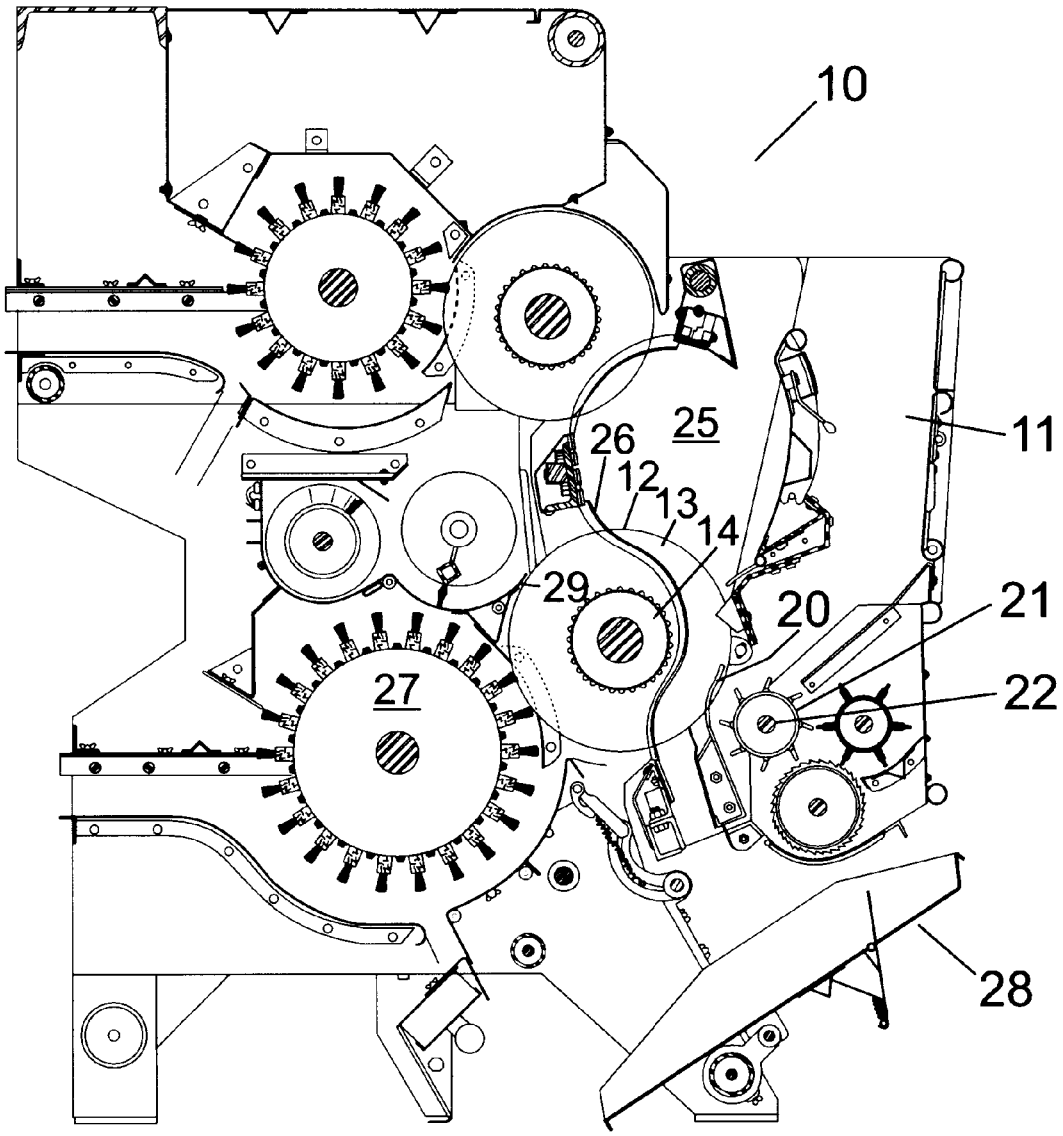
FIG. 1 is a side view of a conventional gin saw stand of the prior art.

For clarity, only the improvements to the gin saw stand in accordance with this invention have been shown in FIGS. 2 and 3. Much of the structure shown in the figures, such as the frame or support members, sheet metal walls, airflow control ducts, and brackets for mounting have not been shown. Those skilled in the art will be able to supply the necessary frame, covers, baffles, duct-work, mounting brackets and other omitted structures based on the disclosure herein and knowledge of the gin stand art. Furthermore, it is understood that a variety of components provided in conventional gin saw stands downstream from the first gin saw for removing and transporting the lint from the first saw, collecting the lint-free seed, and performing other cleaning operations may also be included in the device of this invention. For example, without being limited thereto, doffing brushes 27, seed conveyors 28, or air-blast nozzles (not shown) may be provided on the downstream side of the first gin saw cylinder for removing the lint therefrom for further treatment and baling, while moting systems 29 may also be provided on the downstream side of the gin saw for removing motes. See FIG. 1.

However, other conventional structures are either replaced or no longer serve any useful purpose in the gin saw stand of this invention and may be omitted in the gin saw stand of this invention. Specifically, the huller front, huller ribs, picker roll, and seed fingers in the roll box of conventional gin stands may now be omitted.

It is also understood that the gin saw stand (including saw cylinders, doffing brush cylinders, and other components) may be constructed as a single, integral unit. Alternatively, the device with only the improved roll box, paddle roller, and seed metering roller may be provided as a separate unit which may be combined with or "retrofitted" to an existing gin saw stand.

In another preferred embodiment, the invention optionally provides improved control of the density of the roll in the roll box, thereby allowing improved control of the level of ginning of the lint. Generally, as the density of the roll increases, the ginning of the lint is increased (greater separation of the lint from the seed), up to the point where excessive damage to the fiber and/or seeds occurs. In this embodiment, the density of the roll may be directly correlated to the load on the paddle roller motor 63. Thus, the ginning level may be varied by altering the motor load, which in turn is effected by the feed input rate of seeds and/or seed cotton into the roll box. Conversely, the feed input rate may be automatically controlled to maintain a predetermined load level on motor 63, and thus maintain a predetermined level of ginning of the lint from the seed. In the alternative, rather than sensing the load on the motor 63, control may also be predicated upon measurement of the pressure within the roll box.

Measurement of the load on the motor 63 may be conducted using a variety of well known instruments. For example, without being limited thereto, these may include sensors for measuring the amp load, torque, or power of the motor. The measured load level is communicated to the feeder-extractor, which varies the feed input rate to maintain the predetermined load level. Control of the feeder-extractor may be conducted using appropriate electronic circuitry known in the art. In practice, an increase in the load on the motor above the set point, will indicate an increase in the roll density, signaling the feeder-extractor to reduce the feed rate, while a drop in the motor load will signal an increase in the feed rate. The specific set point of the load level and thus roll density may be readily selected by the user and will vary with the desired level of ginning and throughput.

The combined paddle roller technology of this invention provides a better control signal as well as dual control of the roll box pressure with separate interactive control of seed inlet and outlet rates. This allows significantly improved control of gin stand performance than previously attainable. The seed metering roller controls the rate at which seed exits from the gin stand. Further, by sensing the load of the paddle roller motor, the feeder input rate can be controlled. Setting the feed controller to maintain a higher load on the paddle roller correlates with greater pressure within the seed roll, which gives more complete ginning of the long fibers. This system allows the operator to independently set the speed of the seed metering roller for different processing rates while the load sensing system automatically maintains a fixed load on the paddle roller. Consequently, the operator may maintain the ginning or cleaning level at the desired point even over a wide range of processing rates. Significantly higher processing rates may be used without leaving valuable lint unginned on the seeds.

The following examples are intended only to further illustrate the invention and are not intended to limit the scope of the invention which is defined by the claims.

EXAMPLE 1

An improved gin saw stand of the invention was constructed as shown in FIGS. 2 and 3 by converting an existing gin saw stand with a 12 inch gin saw cylinder. The huller front with the accompanying huller ribs and picker roll were removed, and the roll box was modified by addition of an inlet at the top thereof. A paddle roller was constructed as shown in FIG. 4 from a 2½ in. schedule 80 pipe with four 1½×¼ in. flat steel strips welded thereon. Flat rubber belting strips (2½ in. wide) were bolted along the lengths of each of the welded steel strips. This assembled paddle roller was then mounted in the roll box with a separation between its outer periphery and the outer periphery of the gin saw cylinder of ½ to ¾ in., and its outer periphery separated from nearest wall (left wall in FIG. 2 or 3) of the roll box by ¾ to 1 inch. A seed metering roller was constructed by providing a 1½ in. diameter shaft with five rows of 2½ in. long, 3/16 in. diameter pins (driven into ½ in. deep holes drilled in the shaft). The shape of the roll box and the front of the gin stand were also modified to accommodate these rollers. Drive motors were connected to each of the paddle roller and the seed metering roller sufficient to allow operation of the paddle roller at 155–165 rpm, and the seed metering roller at 5–15 rpm (with the saw operating at 750–850 rpm).

It is understood that the foregoing detailed description is given merely by way of illustration and that modifications and variations may be made therein without departing from the spirit and scope of the invention.

We claim:

1. In a gin saw stand for separating cotton lint from cotton seed comprising a gin saw cylinder having a plurality of spaced apart parallel circular blades rotating about a central axis, ginning ribs between said spaced apart blades of said saw cylinder, and a roll box adjacent to said gin saw cylinder, wherein the improvement comprises:

a) said roll box having a direct inlet for inputting matter selected from the group consisting of seed cotton and seeds, without passing through a huller front;

b) a power driven rotatable paddle roller positioned within said roll box approximately parallel to said saw cylinder and rotating in a direction opposite from said saw cylinder, said paddle roller having a plurality of outwardly extending projections thereon, said outwardly extending projections being of a length effective to independently turn seed said matter within said roll box, and further wherein the outer peripheral surface of said outwardly extending projections are spaced from said saw cylinder a distance effective to allow said matter to pass therebetween; and c) a power driven seed metering roller positioned approximately parallel to said saw cylinder and on the same side of said saw cylinder as said ginning ribs, said metering roller having a plurality of elongated projections extending between said spaced apart blades of said saw cylinder, said seed metering roller rotating in the same direction as said saw cylinder.

2. The gin saw stand of claim 1 wherein said gin saw stand does not include a huller front for receiving seed cotton.

3. The gin saw stand of claim 1 wherein said gin saw stand does not include huller ribs positioned between said spaced apart blades of said saw cylinder.

4. The gin saw stand of claim 1 wherein said gin saw stand does not include a picker roller.

5. The gin saw stand of claim 1 further comprising a drive motor for each of said paddle roller and said seed metering roller.

6. The gin saw stand of claim 5 wherein said drive motors are variable speed motors.

7. A gin saw stand comprising:

a) a fiber gin saw cylinder having a plurality of spaced apart, parallel circular blades rotating about a central axis, each of said blades having a toothed outer peripheral surface, said saw cylinder rotating in a first direction;

b) a plurality of ginning ribs positioned with one said ginning rib in the space between two adjacent blades of said gin saw cylinder and extending above the periphery of the saw on opposed sides thereof;

c) a roll box adjacent to said saw cylinder having an inlet for adding matter selected from the group consisting of seed cotton and ginned cotton seed, to be contacted with said saw cylinder;

d) a power driven rotatable paddle roller having a plurality of outwardly extending projections thereon, said paddle roller positioned within said roller box approximately parallel to said saw cylinder and rotating in a direction opposite from said saw cylinder, said outwardly extending projections being of a length effective to turn said matter within said roll box, and further wherein the outer peripheral surface of said outwardly extending projections are spaced from said saw cylinder a distance effective to allow said matter to pass therebetween; and e) a power driven seed metering roller positioned approximately parallel to said saw cylinder having a plurality of outwardly extending elongated projections extending between said spaced apart blades of said saw cylinder, said seed metering roller rotating in the same direction as said saw cylinder.

8. The gin saw stand of claim 7 further comprising a drive motor for each of said paddle roller and said seed metering roller.

9. The gin saw stand of claim 8 wherein said drive motors are variable speed motors.

* * * * *